US006123525A

United States Patent [19]

Burns

[11] Patent Number: 6,123,525

[45] Date of Patent: Sep. 26, 2000

[54] FLUID PULSATION STABILIZER SYSTEM AND METHOD

[75] Inventor: Oran L. Burns, Del Rio, Tex.

[73] Assignee: Coorstek, Inc., Golden, Colo.

[21] Appl. No.: 09/249,720

[22] Filed: Feb. 12, 1999

[51] Int. Cl.[7] ..... F04B 11/00; B60T 17/04

[52] U.S. Cl. ..... 417/540; 303/87

[58] Field of Search ..... 417/540, 541, 417/542, 543, 544; 239/89, 96; 367/307; 138/30; 181/212; 303/87

[56] References Cited

U.S. PATENT DOCUMENTS

| | | | |
|---|---|---|---|
| 2,051,019 | 8/1936 | Arutunoff . | |
| 2,497,491 | 2/1950 | Douglas | 138/30 |
| 2,682,893 | 7/1954 | Ziebold | 138/30 |
| 3,143,144 | 8/1964 | Peet | 138/40 |
| 3,284,311 | 11/1966 | McHugh | 176/54 |
| 3,422,853 | 1/1969 | Schmid | 138/30 |
| 5,171,134 | 12/1992 | Morgar et al. | 417/540 |
| 5,562,429 | 10/1996 | Romstad et al. | 417/540 |
| 5,860,799 | 10/1999 | Scheibe et al. | 417/540 |
| 5,899,670 | 5/1999 | Ikeda et al. | 417/312 |
| 5,941,283 | 8/1999 | Forte | 138/26 |
| 5,967,623 | 10/1999 | Agnew | 303/87 |

FOREIGN PATENT DOCUMENTS

| | | |
|---|---|---|
| 773378 | 10/1980 | U.S.S.R. . |
| 1048233 | 10/1983 | U.S.S.R. . |
| 1176132 | 8/1985 | U.S.S.R. . |
| 1444580 A1 | 12/1988 | U.S.S.R. . |

*Primary Examiner*—Teresa Walberg
*Assistant Examiner*—Daniel Robinson
*Attorney, Agent, or Firm*—Townsend and Townsend and Crew

[57] ABSTRACT

The invention provides an exemplary pulsation dampener which comprises a vessel which defines an interior for receiving a fluid. At least two resilient cartridges are disposed within the interior of the vessel. The cartridges are pressurized to different pressures so that they will dampen pressure pulses within the fluid which have different pressure peaks.

15 Claims, 3 Drawing Sheets

FLUID PULSATION STABILIZER SYSTEM AND METHOD

BACKGROUND OF THE INVENTION

The invention relates generally to the field of fluid dynamics, and in particular to the dampening or stabilizing of pressure spikes or pulses within a fluid. More specifically, the invention relates to the dampening or stabilizing of pressure peaks or pulses that are created by a reciprocating pump.

The use of pumps to move fluids is well known. Typical reciprocating pumps draw fluid into a pump cylinder where the fluid is pressurized and discharged to force the pressurized fluid through a pipe. When pressurizing the fluids in this manner, various operational issues should be addressed both on the suction side of the pump and on the discharge side of the pump.

Attention to the suction side of the pump is important because if the fluid is unable to properly fill the pump cylinder, the pump cannot operate smoothly. Hence, the pump will be unable to smoothly move the fluid through the discharge system. Moreover, improper feed conditions can result in damaging pressure pulsations within the fluid and cause early failure of valves, valve seats, springs, plungers, expendable parts, and the like.

To operate efficiently, the fluid should stay in continuous contact with the piston or plunger. Factors which prevent such contact include: (1) the action of the pump itself and the demands this action places on the feed system; (2) the nature of the fluid being pumped; and (3) the suction head requirements.

A reciprocating piston pump has a piston that is reciprocated back and forth as the result of crank rotation. Although the crank rotates at a constant rate of rotation, the piston is translated at different rates. For example, a ten degree movement of the crank at the end of the stroke moves the piston only about one percent of the stroke. At midstroke, a ten degree crank movement moves the piston about eight percent of the stroke. Finally, at each end of the stroke, there is no piston movement.

On the intake stroke, the piston begins moving toward the crankshaft at a rapidly increasing speed until it reaches midstroke. This is followed by a rapidly decreasing speed that culminates at the end of the stroke when the piston movement stops momentarily before beginning the discharge stroke. Under even the best of controlled conditions, the changes in fluid velocity that result from the inherent changes in piston velocity can impose severe demands on the pump's feed system.

For the pump cylinder to fill completely, the column of fluid must first be placed in motion at a rate which maintains continuous contact with the pump piston. Additionally, during the intake stroke, the pressure in the cylinder must be greater than the vapor pressure of the fluid being pumped to prevent gas formation and incomplete filling of the cylinder.

The head required on the suction side of the pump is the pressure required at the suction manifold to completely fill the cylinder when the piston is on the suction stroke. Hence, the suction head must be sufficient to: (1) overcome any frictional losses through the piping and fittings; (2) overcome the weight and spring tension of the valves; (3) maintain the fluid pressure above its vapor pressure; and (4) accelerate the flow of fluid in the suction system. Of these four requirements, the acceleration head (item 4) is probably the most commonly overlooked, yet causes more piping and pumping problems than the other three items.

In a suction feed system, the fluid has a mass or weight. The weight of the fluid is determined by the length and diameter of the suction line and specific gravity or density of the fluid.

Because of its mass, every fluid possesses a resistance to flow. Acceleration head is the pressure required to overcome the effect of inertia and to accelerate the fluid as the pump's suction demands. This acceleration head is a function of the fluid mass in the suction line, the pump speed, the number of plungers, and the pump displacement. At higher rotational speeds of many present day pumps, or with longer length suction lines, the acceleration head should be taken into account in designing a piping system.

If the feed system has a high acceleration head that has not been compensated for, the fluid in the suction piping system is unable to accelerate as rapidly as the plunger or piston. This results in loss of contact between the fluid and the piston, creating a vacuum in the cylinder itself. This occurs just prior to midstroke at maximum piston velocity, and has been termed "midstroke cavitation effect." When the piston breaks contact with the fluid, the feed system pressure into the pump decreases producing high frequency pulses in the fluid.

As the piston decelerates after passing midstroke, the fluid rushes into the cylinder producing a high pressure on the piston face. At the end of the stroke, the piston reverses direction and absorbs the kinetic energy of the fluid column. The resulting pressure reversals cause abnormal valve action and are transmitted throughout the pump and its power unit. These pulsations exist regardless of whether the feed system is pressurized to a high level.

Hence, one object of the present invention is to utilize a pulsation dampener or stabilizer to address the effects created by the acceleration head and pump action. As such, it would be desirable to provide a pulsation stabilizer or dampener which is placed on the suction side of the pump to compensate for the acceleration head of the feed system to insure that the cylinder is completely filled at all times, thereby maintaining continuous contact between the fluid and the piston.

On the discharge side of the pump, severe pressure pulsations may be caused by the crank piston arrangement of the pump, the piping, and poor suction conditions. When multiple pump installations are discharged into a common header, the high pressure pulsation surges from each pump may overlap into the common discharge system.

Hence, another object of the invention is to provide a pulsation stabilizer or dampener to stabilize or dampen the pressures on the discharge side of the pump to enable the system to be more safe, dependable, and efficient.

Another important issue that should be addressed on both the suction side of the pump and the discharge side of the pump, is that the pumping system may be operated over a wide range of line pressures. Hence, it is still a further object of the invention to provide a pulsation stabilizer or dampener which is effective at various line pressures. In this way, a single stabilizer or dampener may be employed to dampen or stabilize a wide range of pressure pulses.

SUMMARY OF THE INVENTION

According to the invention, an exemplary pulsation dampener or stabilizer comprises a vessel having an interior for receiving a fluid. Disposed within the interior are at least two resilient cartridges. Each of the cartridges are pressurized to different pressures so that they will dampen pressure pulses within the fluid which have different pressure peaks.

In this way, the pulsation dampener is able to accommodate a wide variety of line pressures and a wide variety of pressure peaks. For example, if a pressure peak entering the vessel was greater than one of the cartridges, but less than the other cartridge, the cartridge at the lesser pressure would absorb the pressure peak. Hence, by including multiple cartridges within the vessel which are each pressurized to a different pressure, the pulsation dampener is able to accommodate a wide variety of pressure peaks.

In one particularly preferable aspect, the vessel includes at least a first opening and a second opening to allow the dampener to be coupled to a first pipe and a second pipe. In this way, a fluid may be flowed through the first pipe, into the interior of the vessel, and out the second pipe, i.e., the vessel is in line with the two pipes. Preferably, the cartridges are displaced from the general flow of fluid through the vessel so as to reduce the frictional losses to the fluid as the fluid passes through the vessel.

In another particular aspect, the cartridges are pressurized to pressures in the range from about 80% to about 120% of the average line pressure. In a typical application, the difference in pressures between the two cartridges is preferably in the range from about 5 psi to about 25 psi. However, it will be appreciated that other pressure differentials may be used depending on the type of system to which the vessel is coupled. Typically, the specific pressure of each cartridge is determined experimentally after installation of the dampener into a system.

The cartridges are preferably constructed of an elastomeric material so that they will flex to absorb pressure peaks which enter into the vessel. Preferably, the cartridges are disposed within the vessel so that they are generally parallel to the central axis of the vessel to reduce the frictional losses of the fluid through the vessel as previously described.

The invention further provides an exemplary system for transporting fluids. The system comprises a pump and a pipe that is operably coupled to the pump so that the pump is able to move fluids through the pipe when operated. A pulsation dampener is coupled to the pipe and comprises a vessel having at least two resilient cartridges which are pressurized to different pressures so that they will dampen pressure pulses within the fluid which have different pressure peaks. In this way, the pulsation dampener may be used with a wide range of line pressures within the system in a manner similar to that previously described.

One particular advantage of the system is that the dampener may be coupled to the pipe upstream of the pump, i.e., on the suction side, or downstream of the pump, i.e., on the discharge side. The pump is preferably a reciprocating pump, such as a positive displacement pump or a plunger pump.

The invention further provides an exemplary method for dampening pressure variations within a fluid that is flowed through a vessel. According to the method, at least two resilient cartridges are placed within the vessel, with the cartridges being pressurized to different internal pressures. The fluid is then flowed into the vessel, and at least two pressure pulses are transmitted through the fluid. The pressure pulses have different pressure peaks, with one of the pressure pulses having a pressure peak that is greater than the internal pressure of both cartridges. As a result, both cartridges are flexed to dampen the pressure pulse. The other pressure pulse has a pressure peak that is between the internal pressures of the two cartridges to cause the cartridge with the lower internal pressure to flex and thereby dampen the pressure pulse having the smaller pressure peak. Preferably, the vessel will include more than two resilient cartridges which are each pressurized to different internal pressures. In this way, the cartridges are able to effectively dampen a wide range of pressure pulses which travel through the fluid.

The fluid is preferably flowed through a pipe that is coupled to the vessel, with the pressure within the pipe being in the range from about 0 psig to about 5000 psig. The pressure peaks can vary widely depending on the type of system. As such, the difference in internal pressures between the cartridges can greatly vary. As one non-limiting example, the difference in internal pressure between the cartridges may be in the range from about 5 psi to about 25 psi when on the suction side of a pump.

The method of the invention is advantageous in that it is able to attenuate pressure pulses by at least about 90% upon their exit from the vessel. In one aspect of the method, the fluid is generally incompressible, and the pressure peaks are transmitted from the reciprocating pump.

DETAILED DESCRIPTION OF THE SPECIFIC EMBODIMENTS

The invention provides exemplary pulsation dampeners or stabilizers, fluid transport systems which include such pulsation dampeners or stabilizers, and methods for dampening pressure pulses within a fluid. In a broad sense, pressure pulsations within a generally incompressible fluid are dampened by use of two or more resilient cartridges which are disposed within a vessel which receives the fluids. The cartridges are pressurized to different internal pressures so that a wide variety of pressure pulses may be dampened within the vessel. In this way, the invention is able to accommodate a wide variety of systems having different line pressures.

The vessels of the invention are preferably constructed of a rigid material while the cartridges are constructed of a flexible or an elastomeric material. Such a configuration takes advantage of the ideal gas law to dampen pressure pulses within a fluid. More specifically, the ideal gas law recites that essentially all gases behave almost identically such that $$p \times V \div T = [\text{constant}].$$

When the temperature is constant, $P_1V_1=P_2V_2$ and is defined as Boyle's Law. Hence, because the vessel remains static, the cartridge flexes when a pressure pulse enters the vessel which is greater than the internal cartridge pressure, thereby changing the volume and equalizing the pressure inside and outside of the cartridge.

The dampeners of the invention are able to dampen pressure pulses or peaks that enter into the interior of the vessels. As such, the dampeners may be employed with any type of system or equipment that produces pressure pulses or peaks that need to be dampened. Preferably, the dampeners will be used in connection with pumps which create the pressure pulses. Typically, the pumps which create such pressure pulses are reciprocating type pumps, such as positive displacement pumps, plunger pumps, and the like.

The dampeners of the invention may be configured to be plumbed in-line with the flow of fluid. Alternatively, the dampeners may include a single opening so that the fluid does not flow through the dampeners.

Figure 1:
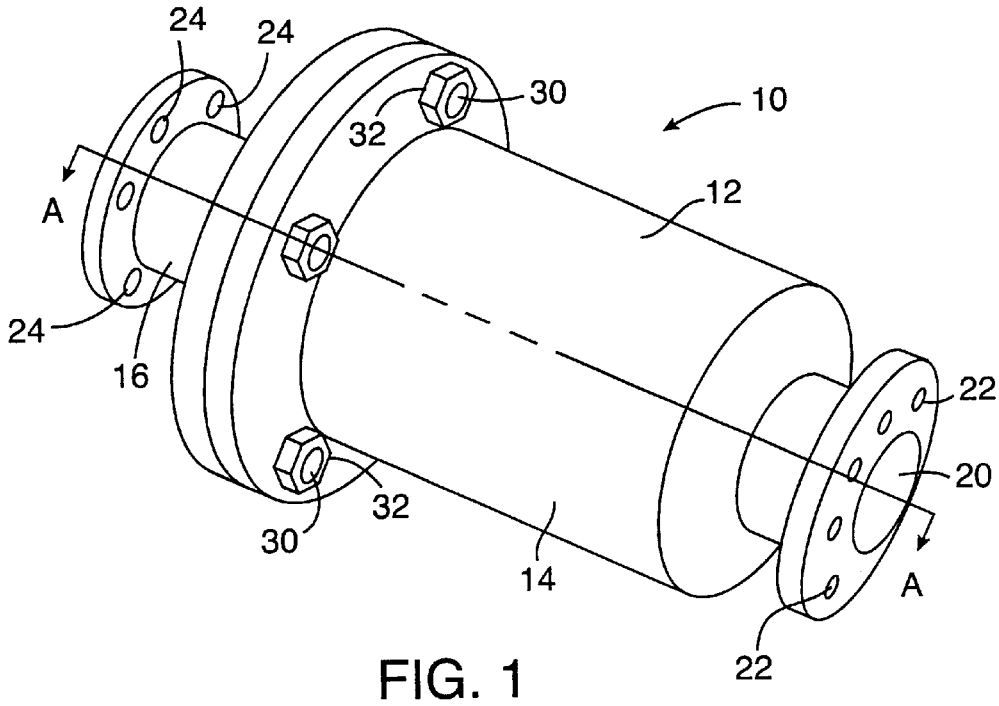
FIG. 1 is a perspective view of an exemplary pulsation dampener according to the invention.

Referring now to FIG. 1, an exemplary embodiment of a pulsation dampener or stabilizer 10 will be described. Dampener 10 comprises a vessel 12 that is conveniently constructed of a main body 14 and an end piece 16. Vessel 12 includes an inlet end 18 and an outlet end 20 as best shown in FIG. 1A. Inlet 18 and outlet 20 are generally aligned with each other and define a central axis of vessel 12. Conveniently, main body 14 includes a plurality of holes 22 near outlet 20, and endpiece 16 includes a plurality of holes 24 to allow vessel 12 to be coupled between two lengths of pipe by inserting bolts through holes 22 and 24 to secure vessel 12 to the pipes. In a similar manner, main body 14 and endpiece 16 include holes 26 and 28, respectively, through which threaded shafts 30 are received as shown in FIG. 1A. On each side of shaft 30 is a nut 32 to secure main body 14 to endpiece 16.

Figure 1B:
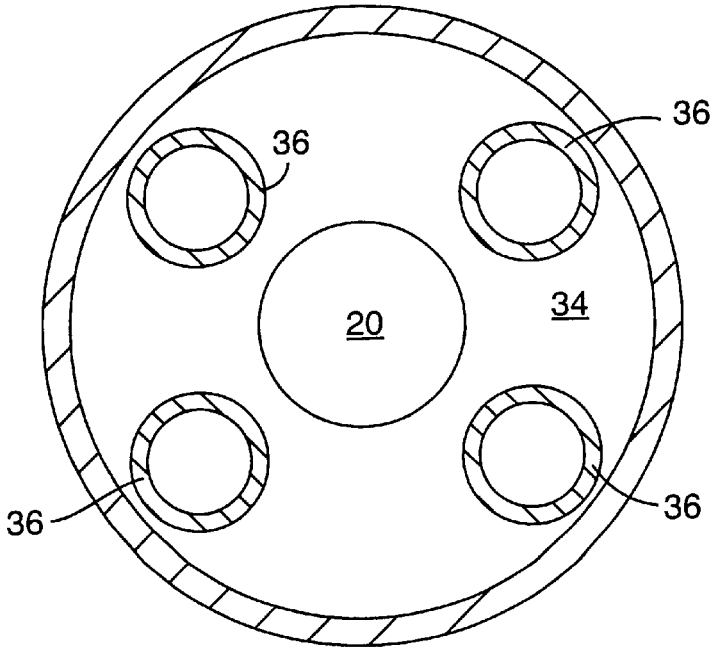
FIG. 1B is a cross-sectional end view of the pulsation dampener of FIG. 1A taken along the lines B—B.
Figure 1A:
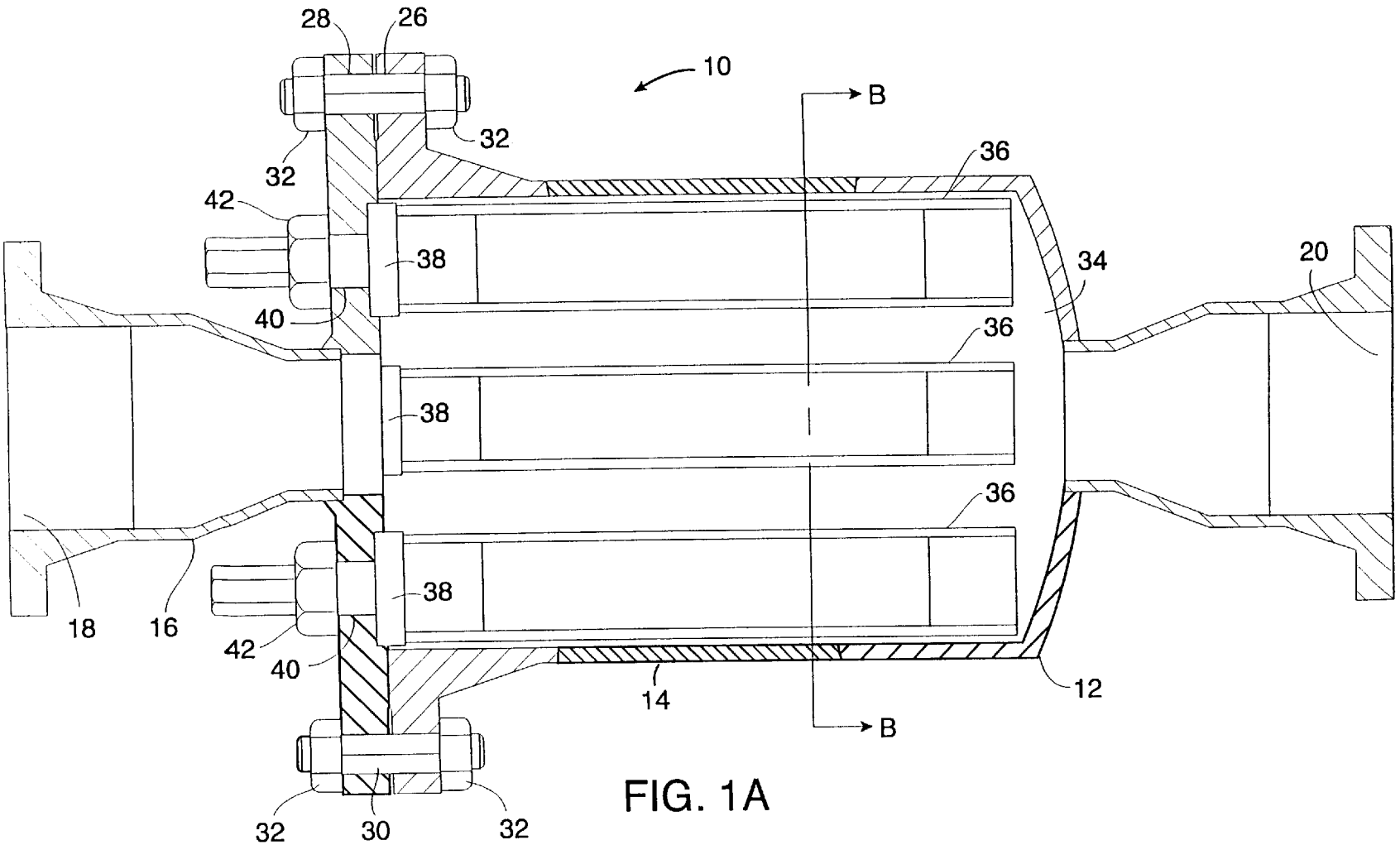
FIG. 1A is a cross-sectional side view of the pulsation dampener of the FIG. 1 taken along lines A—A.

As best shown in FIGS. 1A and 1B, vessel 12 defines an interior 34. As the fluid enters into inlet 18, it passes into interior 34 and then through outlet 20.

Main body 14 and endpiece 16 are constructed of a rigid material capable of withstanding the internal pressure created by the fluid within interior 34. Exemplary materials for constructing vessel 12 include metals such as material specifications SA106, SA105, SA312, and the like. Vessel 12 is preferably constructed so that it will withstand line pressures in the range from about zero to about 5,000 psi, with other applications involving pressures in the range from about zero to about 2,100 psi, and still other applications involving pressures in the range from about zero to about 150 psi.

As best shown in FIGS. 1A and 1B, disposed within interior 34 are a plurality of cartridges 36. As shown, dampener 10 includes four cartridges. However, it will be appreciated that the number of cartridges may be varied depending on the particular application. For example, dampener 10 may include two or more cartridges. Conveniently, each of cartridges 36 includes a base 38 which is configured to be placed through a hole 40 in endpiece 16 and then secured to endpiece 16 by a nut arrangement 42. As shown, cartridges 36 are elongate in geometry and are generally parallel to the central axis of vessel 12. Further, cartridges 36 are generally offset from inlet 18 and outlet 20 so as to reduce the frictional losses in the fluid as the fluid passes through vessel 12. However, it will be appreciated that cartridges 36 may have other geometries and may be disposed in other locations within vessel 12. Further, it will be appreciated that vessel 12 may include only a single opening so that fluids do not flow through vessel 12.

Cartridges 36 are constructed of a resilient material that will flex. In this manner, when the pressure of the fluid within interior 34 is greater than the pressure of the fluid within cartridge 36, the cartridge will flex inward to dampen any pressure pulses. Exemplary materials for constructing cartridge 36 include elastomeric materials, rubber, and the like.

Cartridges 36 are filled with a fluid at a predetermined pressure so that cartridges 36 will flex when the pressure pulses enter into interior 34. Typically, cartridges 36 are charged when the dampener is installed into a fluid delivery system. In this way, the cartridges may be "fine tuned" to the appropriate pressures. An exemplary fluid which may be disposed with in cartridges 36 is nitrogen. Preferably, at least some or all of cartridges 36 are pressurized to different pressures. However, it will be appreciated that in some cases the cartridges may be pressurized to the same pressure. As previously described, the pressurization of cartridges 36 to different pressures is advantageous in that it enables dampener 10 to be used with a wider range of line pressures and pressure pulses. More specifically, a pressure pulse which is not strong enough to cause one of the cartridges 36 to flex, may still be strong enough to flex one of the cartridges which is at a lower pressure. By providing multiple cartridges at different pressures, the range of pressure pulses which may be dampened is greatly increased.

Cartridges 36 are preferably pressurized to internal pressures that are about 80% to about 120% of the average line pressure. However, it will appreciated that a wider range of pressures may be provided within the cartridges depending on the particular application. In cases where the average line pressure is in the range from about zero to about 150 psi, the difference in pressure between each of the cartridges is preferably in the range from about 5 psi to about 25 psi. In this manner, if dampener 10 includes four cartridges, the dampener will be able to handle a wide range of pressure pulses or spikes. By way of example, if the average line pressure were 100 psi, the cartridges may be pressurized to pressures of about 50 psi, 75 psi, 100 psi and 125 psi. If dampener 10 received a pressure spike of about 110 psi, three of the cartridges would flex while the fourth would not. However, flexing of the three cartridges would be sufficient to dampen the pressure spike. If the average line pressure changed to 80 psi, and a 90 psi pressure spike were received, the cartridges at 50 psi and 75 psi would flex to dampen the spike. In this manner, dampener 10 is useful with a wide range of average line pressures and different pressure pulses or spikes.

The configuration of dampener 10 in this manner is advantageous in that it is able to significantly dampen or attenuate pressure spikes. In most cases, dampener 10 able to attenuate at least about 90% of the pressure pulses, and more typically more than about 95%.

Figure 2:
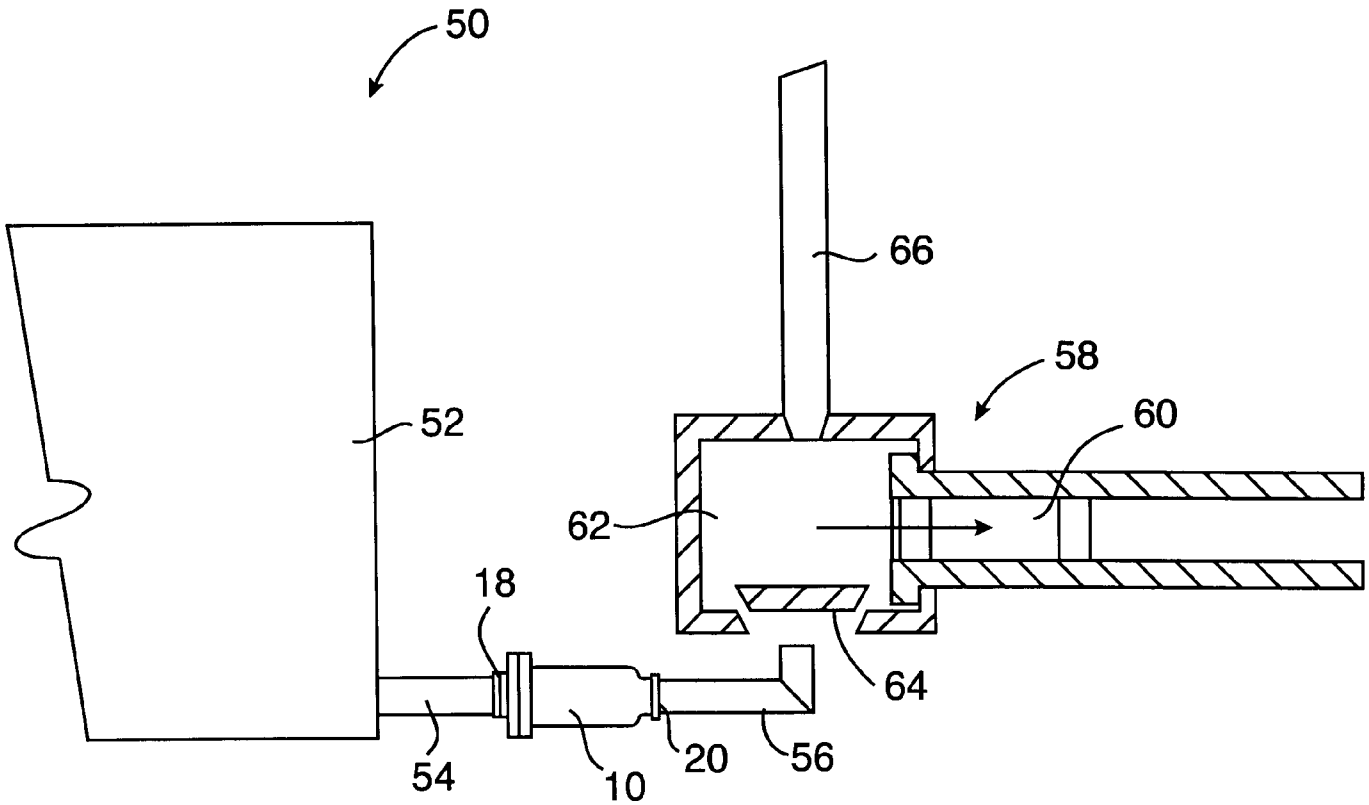
FIG. 2 is a schematic side view of an exemplary system for transporting fluids having the pulsation dampener of FIG. 1.

Referring to FIG. 2, an exemplary system 50 for transporting fluids will be described. System 50 includes a tank 52 which includes a fluid that is to be transported. Extending from tank 52 is a pipe 54 which is coupled to pulsation dampener 10 at inlet 18. Extending from outlet 20 is a second pipe 56. Coupled to pipe 56 is a reciprocating piston pump 58. Pump 58 comprises a reciprocating piston 60, a pump cavity 62, a suction valve 64, and a discharge line 66. In operation, piston 60 is moved in the direction of the arrow to create a vacuum within cavity 62. This causes suction valve 64 to open, thereby drawing fluids into cavity 62. As piston 62 is reciprocated backward, valve 64 is closed and the fluid within cavity 62 is forced out of discharge line 66.

As previously described, if dampener 10 is not included in system 50, the fluid within line 56 may not be able to accelerate as rapidly as piston 60, resulting in loss of contact between the fluid and the piston. Further, at the end of the stroke, where the piston reverses its direction, the piston absorbs the kinetic energy of the fluid column. The resulting pressure reversal causes abnormal valve action which is transmitted through pump 38.

When dampener 10 is included in system 50, dampener 10 serves to store the kinetic energy of the fluid as the piston moves past mid stroke and begins to slow down, and again when the column of fluid is suddenly stopped as the piston reverses direction. More specifically, dampener 10 converts the kinetic energy to potential energy as the cartridges compress. The potential energy can then accelerate the fluid at the same rate as the piston. Hence, when piston 60 starts its intake stroke and suction valve 64 opens, dampener 10 acts as a feed mechanism, releasing potential energy to accelerate the fluid at the same rate as piston 60. In this way, the flow in pipe 56 is effectively stabilized and compensates for the acceleration head of the fluid fed through line 56.

Although shown with dampener 10 on the suction side of valve 58, it will be appreciated that a similar dampener may also be placed on the discharge side, i.e., coupled to discharge line 66. In this way, pressure pulsations which are created by piston 60 when discharging fluids from cavity 62 may be dampened as the pressure pulses travel through the dampener.

When included on the suction side, dampener 10 is preferably placed as close to pump 58 as possible. Typically, dampener 10 will be within about 2 feet, and more preferably about 1.5 feet of pump 58. When on the discharge side, the dampener will preferably be positioned within at least about 1.5 feet of pump 58.

The invention has now been described in detail for purposes of clarity and understanding. However, it will be appreciated that certain changes and modifications may be practiced within the scope of the appended claims.

What is claimed is:

1. A pulsation dampener, comprising:

a vessel defining an interior which is adapted to receive a fluid;

at least two resilient cartridges disposed within the interior of the vessel, wherein the cartridges are pressurized to different pressures and are adapted to dampen pressure pulses within the fluid which have different pressure peaks.

2. A dampener as in claim 1, wherein the vessel includes at least a first opening and a second opening which are adapted to be coupled to a first pipe and a second pipe, respectively, to allow the fluid to be flowed through the first pipe, into the interior of the vessel and out the second pipe.

3. A dampener as in claim 1, wherein the cartridges are pressurized to pressures in the range from about 80% to about 120% of an average line pressure.

4. A dampener as in claim 3, wherein the difference in pressure between the two cartridges is in the range from about 5 psi to about 25 psi.

5. A dampener as in claim 1, wherein the cartridges are constructed of an elastomeric material.

6. A dampener as in claim 1, wherein the vessel includes an axis which is aligned with the flow of liquid through the vessel, and wherein the cartridges are generally parallel to the axis.

7. A dampener as in claim 1, further comprising at least four cartridges disposed within the interior of the vessel, and wherein each of the cartridges is pressurized to a different pressure.

8. A system for transporting a fluid, the system comprising:

a pump;

a pipe operably coupled to the pump, wherein the pump is adapted to move a fluid through the pipe; and a pulsation dampener coupled to the pipe, the dampener comprising a vessel defining an interior which is adapted to receive the fluid flowing through the pipe, and at least two resilient cartridges disposed within the interior of the vessel, wherein the cartridges are pressurized to different pressures and are adapted to dampen pressure pulses within the fluid which have different pressure peaks.

9. A system as in claim 8, wherein the dampener is coupled to the pipe upstream of the pump.

10. A system as in claim 8, wherein the dampener is coupled to the pipe downstream of the pump.

11. A system as in claim 8, wherein the cartridges are pressurized to pressures in the range from about 80% to about 120% of an average fluid pressure within the pipe.

12. A system as in claim 11, wherein the difference in pressure between the two cartridges is in the range from about 5 psi to about 25 psi.

13. A system as in claim 8, wherein the cartridges are constructed of an elastomeric material.

14. A system as in claim 8, wherein the vessel includes an axis which is aligned with the flow of fluid through the vessel, and wherein the cartridges are generally parallel to the axis.

15. A system as in claim 8, wherein the pump is selected from the group of pumps consisting of positive displacement pumps and plunger pumps.

* * * * *